US009091256B2

(12) United States Patent
Zug

(10) Patent No.: US 9,091,256 B2
(45) Date of Patent: Jul. 28, 2015

(54) HYDROSTATIC AXIAL PISTON MACHINE

(75) Inventor: Martin Zug, Hirrlingen (DE)

(73) Assignee: Robert Bosch GmbH, Stuttgart (DE)

( * ) Notice: Subject to any disclaimer, the term of this patent is extended or adjusted under 35 U.S.C. 154(b) by 369 days.

(21) Appl. No.: 13/616,178

(22) Filed: Sep. 14, 2012

(65) Prior Publication Data

US 2013/0239796 A1 Sep. 19, 2013

(30) Foreign Application Priority Data

Sep. 15, 2011 (DE) ..... 10 2011 113 533

(51) Int. Cl.

| | |
|---|---|
| ***F04B 1/29*** | (2006.01) |
| ***F01B 1/06*** | (2006.01) |
| ***F04B 1/32*** | (2006.01) |
| ***F04B 49/00*** | (2006.01) |
| ***F04B 49/08*** | (2006.01) |

(52) U.S. Cl.

CPC ..... *F04B 1/295* (2013.01); *F04B 1/324* (2013.01); *F04B 49/002* (2013.01); *F04B 49/08* (2013.01)

(58) Field of Classification Search

CPC ..... F04B 1/126

USPC ..... 92/12.1, 12.2, 71, 505; 417/356, 363, 417/269; 267/167

See application file for complete search history.

(56) References Cited

U.S. PATENT DOCUMENTS

| | | | | |
|---|---|---|---|---|
| 2,799,874 | A * | 7/1957 | Imhof | 12/10.3 |
| 3,897,036 | A * | 7/1975 | Nystrom | 248/564 |
| 3,942,498 | A * | 3/1976 | Eheim et al. | 123/373 |
| 4,505,241 | A * | 3/1985 | Eheim | 123/373 |
| 4,617,853 | A * | 10/1986 | Wagenseil et al. | 91/505 |
| 5,630,352 | A * | 5/1997 | Todd | 92/12.2 |
| 6,425,313 | B1 * | 7/2002 | Kleinedler et al. | 92/12.2 |
| 7,470,116 | B2 * | 12/2008 | Dantlgraber | 417/269 |
| 7,708,531 | B2 * | 5/2010 | Sakikawa et al. | 417/269 |
| 2010/0150741 | A1 * | 6/2010 | Mehta et al. | 417/53 |
| 2010/0307330 | A1 * | 12/2010 | Dreher et al. | 91/505 |

FOREIGN PATENT DOCUMENTS

| | | |
|---|---|---|
| DE | 199 49 169 A1 | 4/2001 |
| DE | 10 2006 061 145 A1 | 6/2008 |

OTHER PUBLICATIONS

BOSCH REXROTH AG, A10VO . . . DRS, Data Sheet RDE 92703-05-L/09.08, available at least as early as Sep. 15, 2011, an der Kelterweisen 14, 72160 Horb Germany.

* cited by examiner

*Primary Examiner* — Nathaniel Wiehe
*Assistant Examiner* — Qi Gan
(74) *Attorney, Agent, or Firm* — Maginot, Moore & Beck LLP

(57) ABSTRACT

An adjustable hydrostatic axial piston machine of swash plate design includes an actuating apparatus with a cylinder/piston unit and an actuating spring. The actuating apparatus is configured to adjust a pivot cradle of the axial piston machine. The actuating spring engages around at least one axial section of the cylinder/piston unit.

10 Claims, 3 Drawing Sheets

HYDROSTATIC AXIAL PISTON MACHINE

This application claims priority under 35 U.S.C. §119 to patent application no. DE 10 2011 113 533.6, filed on Sep. 15, 2011 in Germany, the disclosure of which is incorporated herein by reference in its entirety.

BACKGROUND

The disclosure relates to an adjustable hydrostatic axial piston machine of swash plate design.

An adjustable hydrostatic axial piston machine of swash plate design has a pivot cradle, on which a swash plate is arranged, on which a multiplicity of working pistons are supported. In order to adjust a pivoting angle of the pivot cradle, an actuating apparatus is known with a cylinder/piston unit and with an actuating spring which acts counter to the latter. Here, either a positive stroke of an actuating piston of the cylinder/piston unit or a positive stroke of the actuating spring can lead to pivoting of the pivot cradle out of a neutral or zero position.

DE 199 49 169 C2 discloses an adjustable hydrostatic axial piston machine of swash plate design, in which the cylinder/piston unit is arranged so as to lie opposite the actuating spring in relation to the pivot cradle. Here, a longitudinal axis of the cylinder/piston unit is set against a drive shaft of the axial piston machine. It is a disadvantage of the solution that the actuating spring has to be of comparatively long configuration, in order to pivot the pivot cradle out of the neutral position. As a result, the axial piston machine is of long construction, in particular in the axial direction. Since the actuating spring has to be compressed or prestressed for installation, both the actuating spring and the pivot cradle are difficult and complicated to install. Furthermore, it is disadvantageous that the actuating spring does not have any axial guidance, apart from at its end sections, and is loaded with transverse forces, since, during pivoting of the pivot cradle, an articulation point of the actuating spring on the pivot cradle is displaced radially or transversely with regard to an articulation point of the actuating spring, which articulation point is fixed to the housing. Since the longitudinal axis of the cylinder/piston unit is set against the drive shaft, an actuating force which is to be applied for pivoting is additionally comparatively high.

The data sheet RDE 92703-05-L/09.08 from the applicant discloses an adjustable hydrostatic axial piston machine of swash plate design which is comparable with DE 199 49 169 C2, with a modified adjustment type but with the same disadvantages.

DE 10 2006 061 145 A1 discloses an adjustable hydrostatic axial piston machine of swash plate design, in which the cylinder/piston unit is likewise arranged so as to lie opposite the actuating spring in relation to the pivot cradle. In a deviation from the prior art shown, the cylinder/piston unit is arranged parallel to the drive shaft in order to reduce the actuating force to be applied, and the actuating piston is supported via a sliding pad on an identical sliding face of the swash plate, on which the working pistons are also supported. In addition, firstly the actuating piston and the working pistons and secondly their sliding pads are of structurally identical configuration, which reduces the outlay in apparatus and manufacturing terms. However, it is still a disadvantage of the solution that the actuating spring is long, with the result that firstly the actuating spring and the pivot cradle are difficult to install and secondly the actuating spring is loaded with transverse forces during pivoting of the pivot cradle.

In contrast, the disclosure is based on the object of providing an adjustable hydrostatic axial piston machine of swash plate design which is of smaller overall construction.

SUMMARY

This object is achieved by an adjustable hydrostatic axial piston machine of swash plate design having the features of the disclosure.

The hydrostatic axial piston machine according to the disclosure has a housing and an adjustable swash plate which is mounted in the housing such that it can be pivoted via a pivot cradle. A pivoting angle of the pivot cradle can be set via an actuating apparatus which has a cylinder/piston unit and an actuating spring which acts counter to the latter. Here, according to the disclosure, at least one axial section of the cylinder/piston unit is engaged around by the actuating spring. In contrast to the prior art, the actuating spring and the cylinder/piston unit therefore utilize a common installation space in the axial and radial directions. The hydrostatic axial piston machine can therefore be of smaller and less expensive design. In addition, the actuating spring is given axial guidance by that section of the cylinder/piston unit which is engaged around by it. It is a great advantage to utilize the installation space saved in this way for reinforcement of the actuating spring, as a result of which greater actuating forces of the actuating spring are made possible with a simultaneously lower spring rate. A stronger spring has shorter actuating or restoring times, as a result of which, for example, a hard spot characteristic of a hydraulic steering system can be eliminated.

In one particularly preferred development, the cylinder/piston unit is arranged together with the actuating spring radially adjacently to a cylinder drum of the hydrostatic axial piston machine. The cylinder/piston unit and the actuating spring which engages around it therefore do not require an additional installation space section in the axial direction, but rather are arranged in the installation space section which is occupied in any case by the cylinder drum. As an alternative to this, which is less advantageous, however, the cylinder/piston unit could be arranged, together with the actuating spring which engages around it, so as to lie opposite the cylinder drum with regard to the pivot cradle.

In one preferred development, in order to introduce an actuating force of the actuating apparatus particularly effectively into the pivot cradle, a longitudinal axis of the cylinder/piston unit is arranged approximately parallel to a rotational axis of the cylinder drum of the axial piston machine.

It is particularly advantageous if an end section of an actuating cylinder of the cylinder/piston unit is arranged or fastened on/to the housing or on/to a part which is fixed to the housing. In this way, the cylinder/piston unit can be supplied with pressure medium in a particularly compact and simple manner in apparatus terms via a pressure medium channel which is formed in the housing or the part which is fixed to the housing. The actuating cylinder preferably has a connection section with an external thread, which connection section is penetrated by a connection hole, the connection section being screwed into a connection hole of the housing or the part which is fixed to the housing, which connection hole has an internal thread. As an alternative to this, the actuating cylinder can also be configured in one piece with the housing or the part which is fixed to the housing.

In one advantageous development, an actuating piston of the cylinder/piston unit, which actuating piston is axially displaceable or guided in the actuating cylinder, is supported via a sliding pad on a sliding face of the pivot cradle or the swash plate. Since working pistons of the axial piston machine are likewise preferably supported via sliding pads on the sliding face of the pivot cradle or the swash plate, firstly the actuating piston and the working pistons and secondly their sliding pads can in each case be of structurally identical configuration, which reduces the outlay in apparatus terms and in manufacturing terms. It is preferred here if the actuating piston has a spherical head on an end section on the pivot cradle side, which spherical head is received in a ball-shaped or spherical recess of the sliding pad.

One particularly advantageous development results if a first end section of the actuating spring is coupled to an axially displaceable guide disk, by which the actuating cylinder is engaged around circumferentially, and if a second end section of the actuating spring is coupled to a radial shoulder of the actuating cylinder and the guide disk is connected here via a drawing means to an articulation point of the pivot cradle. It is particularly preferred if the guide disk has little play radially with regard to the actuating cylinder, and the radial shoulder and the guide disk are arranged normally with respect to the longitudinal axis of the actuating cylinder. This ensures that the guide disk and the actuating spring are arranged substantially coaxially with respect to the actuating cylinder, independently of the pivoting angle. As a result, the actuating spring has to absorb practically no more transverse forces, which considerably simplifies a structural design of the actuating spring and makes oversizing unnecessary. This saves weight and installation space.

The actuating spring is preferably configured as a compression spring, and the guide disk is arranged between the radial shoulder and that end section of the actuating cylinder which is arranged on the housing or on the part which is fixed to the housing. The actuating spring is then supported by way of its end sections on the radial shoulder and the guide disk.

As an alternative to this, if the guide disk is arranged between the radial shoulder and the swash plate, the actuating spring can be configured as a tension spring.

It is particularly advantageous if a securing element is arranged on the actuating cylinder between the guide disk and that end section of the actuating cylinder which is arranged on the housing or on the part which is fixed to the housing, with the result that firstly a stroke of the actuating spring can be restricted and secondly said actuating spring can be installed on the actuating cylinder in a prestressed state. As a result, the actuating apparatus is available as a preassembled assembly, consisting of the cylinder/piston unit, the actuating spring, the guide disk and the drawing means, which overall simplifies the installation of the actuating apparatus in the axial piston machine and the installation of the pivot cradle. The securing element is preferably a securing ring which is arranged in a groove of the actuating cylinder.

In one preferred development, a lever arm of the pivot cradle is engaged around by the drawing means, or the drawing means is hooked into a notch of the pivot cradle or into a notch of the lever arm. This results in particularly simple fastening of the drawing means in apparatus terms, with only low outlay on installation.

It is very particularly advantageous if the guide disk is connected to the drawing means such that it can be tilted or rotated or pivoted, and a tilting, rotational or pivot axis is approximately parallel to a pivot axis of the pivot cradle. A connection of this type can be formed, for example, via tilting or rotary or pivoting joints. In this way, an orientation of the guide disk is decoupled from a radial deflection of the articulation point of the drawing means on the pivot cradle. The guide disk, and also the actuating spring as a result, are therefore oriented substantially coaxially with respect to the longitudinal axis of the cylinder/piston unit, which prevents tilting of the guide disk on the actuating cylinder and loading of the actuating spring with transverse forces.

BRIEF DESCRIPTION OF THE DRAWINGS

In the following text, one exemplary embodiment of an adjustable hydrostatic axial piston machine according to the disclosure which is operated as an axial piston pump will be explained in greater detail using four drawings, in which.

DETAILED DESCRIPTION

Figure 1:
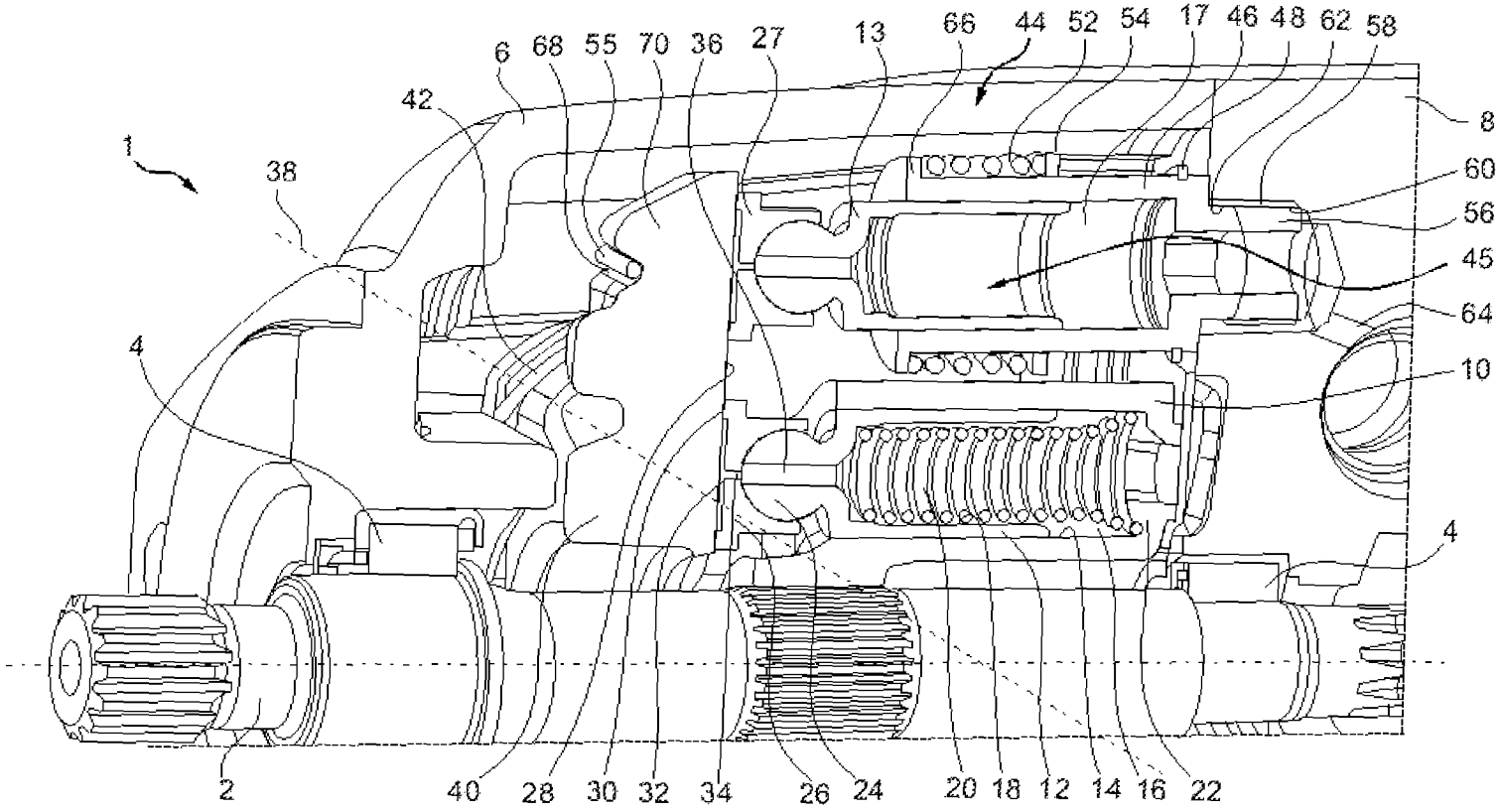
FIG. 1 shows the exemplary embodiment of the adjustable hydrostatic axial piston pump in the neutral position, in an enlarged perspective partial section.

FIG. 1 shows the exemplary embodiment of the adjustable hydrostatic axial piston pump 1 in the neutral position, in a perspective partial section. Here, the neutral position and every other stationary pivoting angle of a pivot cradle 40 result from an equilibrium of forces between a spring force of an actuating spring 52 and a piston force of an actuating piston 13.

The section is restricted to that region of the axial piston pump 1 which is relevant for the summary of the disclosure. The axial piston pump 1 has a drive shaft 2 which is mounted via two anti-friction bearings 4 in a cup-shaped housing part 6 and in a housing cover 8. A cylinder drum 10, in which a multiplicity of pistons 12 are guided axially displaceably, is connected fixedly to the drive shaft 2 so as to rotate with it. Said pistons 12 in each case delimit a working space 16 with a cylinder bore 14 of the cylinder drum 10.

Here, the pistons 12 have a piston hole 18, in which a pressure spring 20 is received. On a right-hand side in FIG. 1, the pressure spring 20 is supported on a radial shoulder 22 of the cylinder bore 14. A feed of pressure medium to the working space 16 and a discharge of the pressure medium from said working space 16 is controlled during a rotation of the drive shaft 2 by a control plate (not shown) which is fixed to the housing.

Piston feet 24 of the pistons 12, which piston feet 24 project out of the cylinder drum 10, are supported via sliding pads 26 on a sliding face 28 of a swash plate. Here, each sliding pad has a sliding face 30 with a groove 32 which is connected to the working space 16 via a connecting hole 34 in the sliding pad 26 and via a connecting hole 36 in the piston foot 24. In this way, the sliding pad 26 is supplied with pressure medium out of the working space 16 and is supported in a sliding manner on the sliding face 28 of the swash plate.

The swash plate is mounted in the housing part 6 on two pivoting bearings 42 (only one shown) via the pivot cradle 40 which can be pivoted about a pivot axis 38. In FIG. 1, an actuating apparatus 44 is arranged above the cylinder drum 10, for adjusting the pivoting angle of the pivot cradle 40. Said actuating apparatus 44 comprises a cylinder/piston unit 45 which has an actuating cylinder 46, in which the actuating piston 13 is arranged axially displaceably. Furthermore, the actuating apparatus 44 comprises a securing ring 48, the actuating spring 52, a guide disk 54, a pull bow 55 and a sliding pad 27.

The actuating cylinder 46 has a connection journal 56 which is screwed with an external thread 58 into a connection hole of a pressure medium channel 64 of the housing cover 8, which connection hole has an internal thread 62. The connection journal 56 is penetrated by a connection hole 60, with the result that the actuating cylinder 46 can be loaded with control pressure via the pressure medium channel 64.

In order to keep outlay in manufacturing terms low and to simplify the installation, firstly the actuating piston 13 is structurally identical with the working piston 12 and secondly the sliding pad 27 of the actuating piston is structurally identical with the sliding pad 26 of the working piston 12. The support of the sliding pad 27 on the sliding face 28 of the swash plate and its lubrication are therefore structurally identical with the support and lubrication of the sliding pads 26 of the working pistons. In contrast to the working pistons 12, however, the actuating piston 13 does not have a pressure spring 20, since it is pressed onto the sliding face 28 by being loaded with pressure medium out of the pressure medium channel 64.

The actuating spring 52 is supported with its left-hand end section in FIG. 1 on a radial shoulder 66 of the actuating cylinder 46 and with its opposite end section on the guide disk 54. In the neutral position of the pivot cradle 40 shown in FIG. 1, the actuating spring 52 is under compressive stress. The guide disk 54 is coupled to the pivot cradle 40 via the pull bow 55 which is hooked into a notch 68 of a lever arm 70 of said pivot cradle 40.

In the neutral position, the delivery volume of the axial piston pump 1 is equal to zero, since the pivoting angle is zero. There is an equilibrium between a spring force of the actuating spring 52 and a piston force of the actuating piston 13.

If a pressure in the working space 17 is lowered by a defined amount, this equilibrium is disrupted. The actuating spring 52 which is supported on the radial shoulder 66 begins to push the guide disk 54 to the right in FIG. 1. The guide disk 54 drives the lever arm 70 via the pull bow 55, and drives the actuating piston 13 via said lever arm 70. The actuating spring 52 is relieved during the pivoting out of the pivot cradle 40 in the clockwise direction, with the result that its spring force decreases as the pivoting angle increases. As soon as an equilibrium has been set again between the spring force of the actuating spring 52 and the piston force of the actuating piston 13, the pivoting movement of the pivot cradle 40 is stopped.

Figure 2:
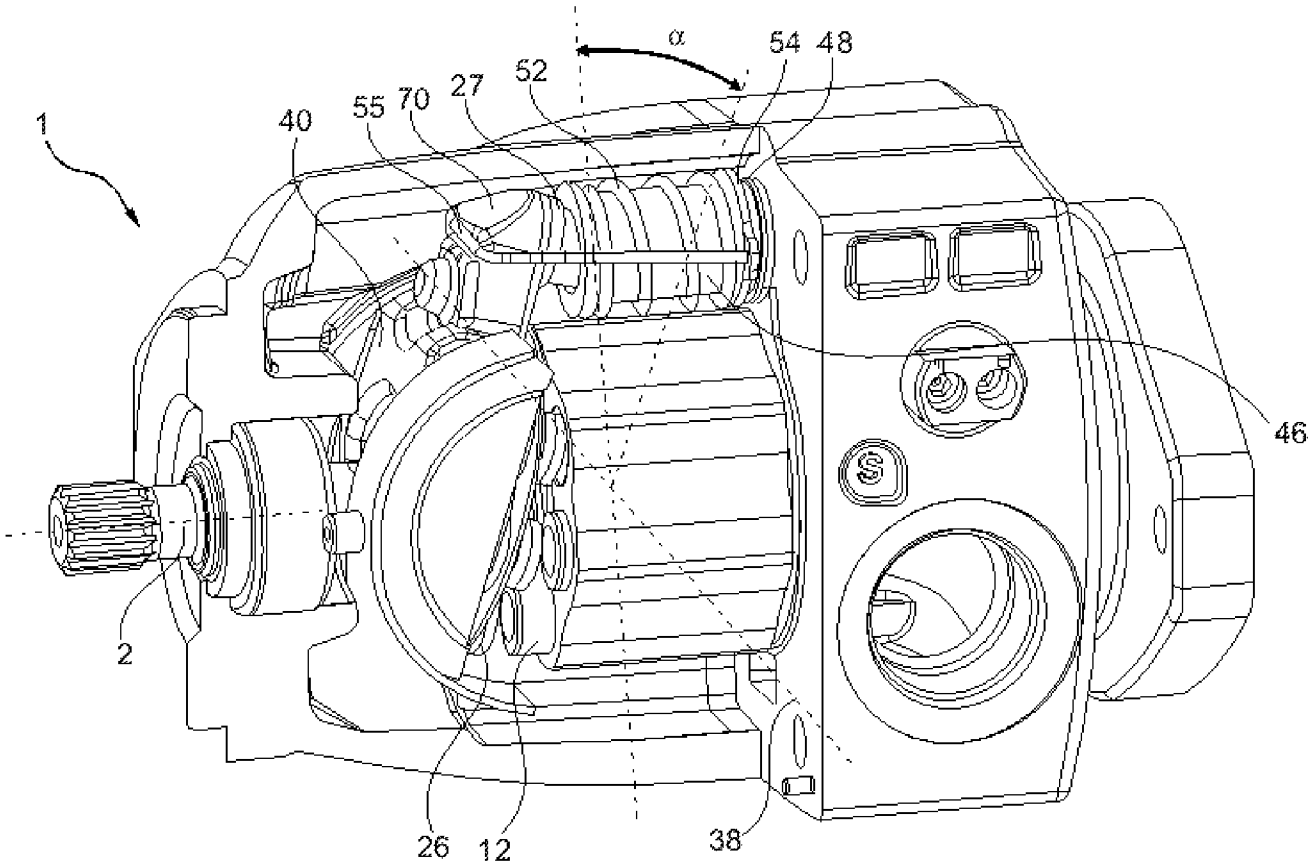
FIG. 2 shows the exemplary embodiment of the adjustable hydrostatic axial piston pump according to FIG. 1 in a fully pivoted-out position, in a perspective partial section.

FIG. 2 shows the axial piston pump 1 according to FIG. 1 in a fully pivoted-out position, in a perspective partial section.

The pivot cradle 40 is pivoted about the pivot axis 38 by the maximum pivoting angle $\alpha$ of 20°. Here, the pivoting angle is limited via a stop (not shown). It can be seen readily that, on account of the pivoting angle $\alpha$, the working pistons 12 are then no longer in a neutral position, and the axial piston pump 1 therefore has a delivery volume during rotation of the drive shaft 2.

The actuating spring 52 is dimensioned in such a way that it is not relieved at the maximum pivoting angle $\alpha$ of 20°. In this position, the guide disk 54 is at a small spacing from the securing ring 48.

If pressure medium is conveyed into the actuating cylinder 46 out of the fully pivoted-out position which is shown in FIG. 2, the actuating piston 13 begins to move to the left in FIG. 2 (cf. FIG. 1). This axial movement is transmitted via the sliding pad 27 to the lever arm 70 of the pivot cradle 40 and therefore pivots the latter. Here, the pull bow 55 drives the guide disk 54 on the actuating cylinder 46 to the left in FIG. 2, as a result of which the actuating spring 52 is once again compressed. Its spring force is increased as a result. The pivoting has ended when an equilibrium of forces has been established between the spring force of the actuating spring 52 and the piston force of the actuating piston 13 (cf. FIG. 1).

Figure 3:
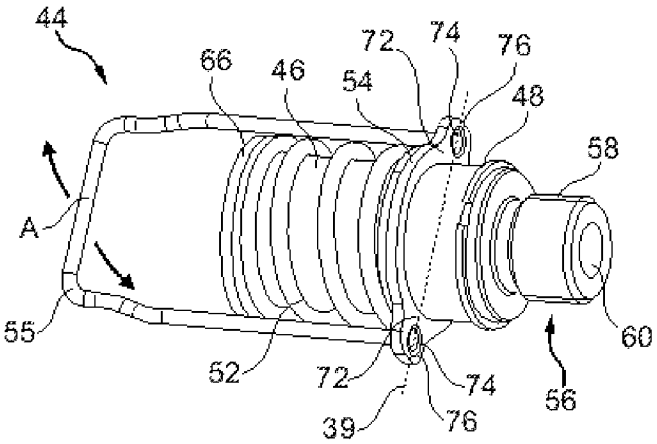
FIG. 3 shows an actuating apparatus of the exemplary embodiment according to FIGS. 1 and 2 in a partially pivoted-out position, in a perspective view.

FIG. 3 shows the actuating apparatus 44 of the first exemplary embodiment according to FIGS. 1 and 2 without actuating piston in a partially pivoted-out position, in a perspective view.

The actuating apparatus 44 has the actuating cylinder 46 with the securing ring 48 and the actuating spring 52 with the guide disk 54 and the pull bow 55. On its right-hand end section in FIG. 3, the actuating cylinder 46 has the connection journal 56 with the external thread 58. The connection journal 56 is penetrated by the connection hole 60, via which the actuating cylinder 46 can be loaded with pressure medium.

The guide disk 54 and the pull bow 55 are connected to one another in a simple way such that they can be tilted via a tilting joint. To this end, on two sections 72 which are arranged diametrically with respect to one another, the guide disk 54 has radial widened portions which are engaged through by in each case one end section 74 of the pull bow 55. Here, the end sections 74 are flattened in a spherical or lenticular manner, with the result that they can absorb tensile forces. If the actuating apparatus 44 is installed in the axial piston machine or in the axial piston pump 1 according to FIGS. 1 and 2, the two end sections 74 are aligned with a tilting axis 39 which is arranged parallel to the pivot axis 38 (cf. FIG. 1 or 2). The end sections 74 which are flattened in a spherical or lenticular manner are received in the guide disk 54 in recesses 76 which are likewise shaped in a spherical or lenticular but concave manner.

An orientation of the guide disk 54 on the actuating cylinder 46 is decoupled via said tilting joint from a deflection of an articulation point A of the pull bow 55 (or the pivot cradle 40, cf. FIG. 1). The guide disk 54, and also the actuating spring 52 as a result, are therefore always oriented substantially coaxially with respect to the longitudinal axis of the actuating cylinder 46, which prevents tilting of the guide disk 54 on the actuating cylinder 46 and loading of the actuating spring 52 with transverse forces.

Figure 4:
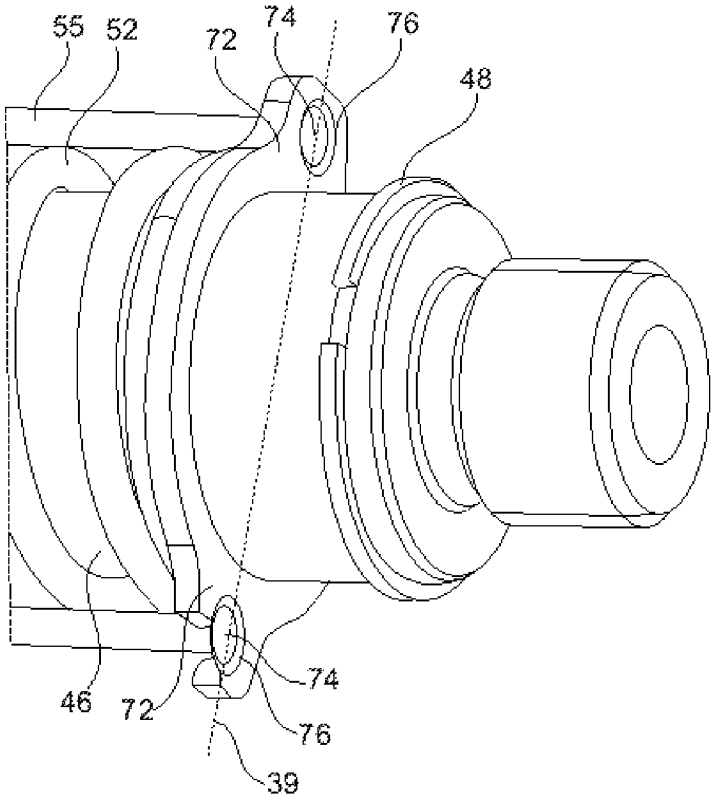
FIG. 4 shows a detail of the actuating apparatus of the exemplary embodiment according to FIGS. 1 to 3, in a perspective view.

In order to illustrate this simple tilting joint, FIG. 4 shows a partial section of the guide disk 54 in an enlarged illustration.

Here, the pull bow engages through the section 72 with some play and, on the right in FIG. 4, forms the end section 74 which is flattened in a spherical or lenticular manner. As a result of the flattened portion, the end section 74 is widened radially, with the result that the pull bow 55 can transmit tensile forces which are directed to the left in FIG. 4 to the guide disk 54. During pivoting of the pivot cradle 40 (cf. FIGS. 1 and 2), the pull bow 55 pivots about the tilting axis 39 which extends through the two end sections 74. On account of the play between the pull bow 55 and the end sections 74 and the spherical shape of the end sections 74 and the recesses 76, no torque or tilting moment can be transmitted here between the pull bow 55 and the guide disk 54, with the result that the guide disk 54 does not tilt on the actuating cylinder 46 and the actuating spring is always oriented coaxially with respect to the actuating cylinder.

In a deviation from the embodiment as an axial piston pump 1, the axial piston machine can also be an axial piston engine.

The axial piston machine can have pivoting angles of greater than 20° and are designed such that they can be pivoted through, that is to say pivoting angles of <0 and >0 are possible.

The recesses 76 can be provided as a conical seat or as a spherical seat in the sections 72 of the guide disk 54. The pull bow 55 can be manufactured, for example, from inexpensive spoke material.

An adjustable hydrostatic axial piston machine of swash plate design is disclosed which has an actuating apparatus with a cylinder/piston unit and an actuating spring for adjusting a pivot cradle. Here, according to the disclosure, at least one axial section of the cylinder/piston unit is engaged around by the actuating spring.

What is claimed is:

1. A hydrostatic axial piston machine, comprising:

a housing;

an adjustable swash plate mounted in the housing such that it the adjustable swash plate is configured to be pivoted via a pivot cradle; and an actuating apparatus having a cylinder/piston unit and an actuating spring, the actuating apparatus being configured to set a pivoting angle of the pivot cradle, wherein the cylinder/piston unit includes an actuating cylinder and an actuating piston guided in the actuating cylinder, the actuating piston being configured to pivot the pivot cradle in a first direction, wherein the actuating spring is configured to pivot the pivot cradle in a second direction opposite to the first direction, wherein at least an axial section of the actuating cylinder is encompassed by the actuating spring, and wherein the actuating spring has a first end section and a second end section, the first end section being connected via a drawing mechanism to the pivot cradle and the second end section resting against a radial shoulder of the actuating cylinder.

2. The hydrostatic axial piston machine according to claim 1, wherein the cylinder/piston unit is arranged radially adjacently to a cylinder drum of the axial piston machine.

3. The hydrostatic axial piston machine according to claim 1, wherein a longitudinal axis of the cylinder/piston unit is approximately parallel to a rotational axis of a cylinder drum of the axial piston machine.

4. The hydrostatic axial piston machine according to claim 1, wherein the actuating cylinder includes an end section arranged on the housing or on a part that is fixed to the housing.

5. The hydrostatic axial piston machine according to claim 4, wherein the actuating piston is configured to be displaced axially in the actuating cylinder and is supported via a sliding pad on a sliding face of the pivot cradle or the swash plate.

6. The hydrostatic axial piston machine according to claim 4, wherein the first end section of the actuating spring is coupled to an axially displaceable guide disk that circumferentially engages around the actuating cylinder, the guide disk being connected via the drawing mechanism to an articulation point of the pivot cradle.

7. The hydrostatic axial piston machine according to claim 6, wherein the guide disk is arranged between the radial shoulder and the end section of the actuating cylinder.

8. The hydrostatic axial piston machine according to claim 6, further comprising a securing element arranged on the actuating cylinder between the guide disk and the end section of the actuating cylinder.

9. The hydrostatic axial piston machine according claim 6, wherein the pivot cradle has a lever arm, the drawing mechanism engaging around the lever arm or being hooked into a notch of the lever arm.

10. The hydrostatic axial piston machine according to claim 6, wherein the drawing mechanism is mounted on the guide disk such that the drawing mechanism is configured to be rotated, pivoted, or tilted about a respective rotational, pivot, or tilting axis, the rotational, pivot, or tilting axis being approximately parallel to a pivot axis of the pivot cradle.

* * * * *

UNITED STATES PATENT AND TRADEMARK OFFICE

CERTIFICATE OF CORRECTION

PATENT NO. : 9,091,256 B2
APPLICATION NO. : 13/616178
DATED : July 28, 2015
INVENTOR(S) : Martin Zug It is certified that error appears in the above-identified patent and that said Letters Patent is hereby corrected as shown below:

In the claims

Lines 12-16 of column 7, which includes a portion of claim 1, should read as follows.

1. A hydrostatic axial piston machine, comprising:
a housing;
an adjustable swash plate mounted in the housing such that (clean)
the adjustable swash plate is configured to be pivoted
via a pivot cradle; and Signed and Sealed this
Twelfth Day of January, 2016

Michelle K. Lee

Michelle K. Lee
*Director of the United States Patent and Trademark Office*